US008875695B2

(12) United States Patent
Yi

(10) Patent No.: US 8,875,695 B2
(45) Date of Patent: Nov. 4, 2014

(54) BUILT-IN COOKING APPLIANCE

(75) Inventor: Soo Cheol Yi, Changwon (KR)

(73) Assignee: LG Electronics Inc., Seoul (KR)

( * ) Notice: Subject to any disclaimer, the term of this patent is extended or adjusted under 35 U.S.C. 154(b) by 1371 days.

(21) Appl. No.: 12/448,779

(22) PCT Filed: Nov. 15, 2007

(86) PCT No.: PCT/KR2007/005756

§ 371 (c)(1),
(2), (4) Date: Oct. 20, 2009

(87) PCT Pub. No.: WO2008/084918

PCT Pub. Date: Jul. 17, 2008

(65) Prior Publication Data

US 2010/0031948 A1 Feb. 11, 2010

(30) Foreign Application Priority Data

Jan. 8, 2007 (KR) ..... 10-2007-0001890
Jan. 9, 2007 (KR) ..... 10-2007-0002547
Jan. 9, 2007 (KR) ..... 10-2007-0002549
Jan. 9, 2007 (KR) ..... 10-2007-0002569

(51) Int. Cl.
*F24C 15/10* (2006.01)
*F24C 15/30* (2006.01)

(52) U.S. Cl.
CPC ..... *F24C 15/30* (2013.01); *F24C 15/101* (2013.01)
USPC ..... 126/214 A; 126/37 A; 219/452.12

(58) Field of Classification Search
USPC .... 126/1 R, 214 A, 299 D, 37 A, 37 K, 39 H; 216/451.1, 452.12, 623; 219/451.1, 219/452.12, 623
See application file for complete search history.

(56) References Cited

U.S. PATENT DOCUMENTS

| | | | | |
|---|---|---|---|---|
| 4,665,893 | A * | 5/1987 | Miyagawa et al. | 126/299 D |
| 4,899,028 | A * | 2/1990 | Arai et al. | 219/623 |
| 5,446,268 | A * | 8/1995 | Chen | 219/623 |
| 7,533,666 | B2 * | 5/2009 | Hosoi et al. | 126/214 A |
| 2006/0144388 | A1 | 7/2006 | Hosoi et al. | |

FOREIGN PATENT DOCUMENTS

| | | | | |
|---|---|---|---|---|
| CN | 2632533 | Y | 8/2004 | |
| JP | 57-145296 | | 9/1982 | |
| JP | 57-182014 | | 11/1982 | |
| JP | 01082475 | A * | 3/1989 | |
| JP | 01109681 | A * | 4/1989 | |
| JP | 03114176 | A * | 9/1989 | 219/623 |
| JP | 3122990 | | 12/1991 | |
| JP | 05-121155 | | 5/1993 | |
| JP | 06-005358 | | 1/1994 | |
| JP | 2690156 | | 8/1997 | |
| JP | 11354263 | | 12/1999 | |
| JP | 2005-265209 | | 9/2005 | |
| JP | 2005265209 | | 9/2005 | |

(Continued)

*Primary Examiner* — Stephen M Hepperle
*Assistant Examiner* — R. K. Arundale
(74) *Attorney, Agent, or Firm* — McKenna Long & Aldridge LLP

(57) ABSTRACT

A built-in cooking appliance includes a main body, a top plate provided above the main body, a cabinet supporting the top plate, a support forming an airflow space between a side of the top plate and the cabinet and allowing the top plate to be supported by the cabinet even at the space, and an air outlet allowing internal air of the main body to be discharged through the support.

21 Claims, 10 Drawing Sheets

(56) References Cited

FOREIGN PATENT DOCUMENTS

| | | | |
|---|---|---|---|
| JP | 2006-322645 | | 11/2006 |
| KR | 10-0286739 | | 1/2001 |
| KR | 10-2002-0045380 | | 6/2002 |
| KR | 10-2004-0049779 | | 6/2004 |
| KR | 10-0540560 | | 12/2005 |
| RU | 1732 | U1 | 2/1996 |
| RU | 2187046 | | 8/2002 |
| RU | 2303748 | | 7/2007 |
| WO | WO2005/088199 | * | 9/2005 |

* cited by examiner

BUILT-IN COOKING APPLIANCE

This application claims the benefit of PCT/KR2007/005756 filed on Nov. 15, 2007, and Korean Patent Application Nos. 10-2007-0001890 filed on Jan. 8, 2007, 10-2007-002549 filed on Jan. 9, 2007, 10-2007-0002569 filed on Jan. 9, 2007, and 10-2007-0002547 filed on Jan. 9, 2007 the contents of which are hereby incorporated herein by reference for all purposes in their entirety.

TECHNICAL FIELD

This document relates to a built-in cooking appliance and, more particularly, to a built-in cooking appliance having a top plate on which food is cooked.

BACKGROUND ART

A built-in cooking appliance is a kitchen appliance installed on a cabinet. That is, the built-in cooking appliance is associated with kitchen furniture so that a user can conveniently use the same. The built-in cooking appliance makes the interior of the kitchen beautiful.

In recent years, a built-in cooking appliance having a top plate, which can cook the food using heat transmitted to the food through the top plate, has been developed. Such a built-in cooking appliance having the top plate is called a hot plate, a hob, a range, or a cook-top. Regardless of the name, a concept of the present invention may be applied to any cooking appliances having the top plate. In the following description, a terminology "cooking appliance" means a cooker having the top plate.

In order to operate components of the cooker under a thermally-stable state, a typical cooking appliance is designed such that air flows in and out of the cooking appliance. To realize this, the top plate is mounted protruding above the top surface of the top plate by a predetermined height. In this case, it is difficult to clean a portion around the top plate and an outer appearance is deteriorated.

In the typical cooking appliance, water may flow into a main body of the cooking appliance through an air passage hole formed on the top plate or a portion around the top plate. The water flowing into the main body of the cooking appliance may cause a short circuit or malfunction of the cooking appliance. This problem must be most considered in designing the cooking appliance as the cooking appliance is used in the kitchen where the water is frequently used.

DISCLOSURE OF INVENTION

Technical Problem

Embodiments provide a built-in cooking appliance that is configured to effectively cool an inside of the cooking appliance, minimize a protruding height of the cooking appliance from a cabinet, and reduce possibility that water flows into the cooking appliance.

Technical Solution

In one embodiment, a built-in cooking appliance includes a main body; a top plate provided above the main body; a cabinet supporting the top plate; a support forming an airflow space between a side of the top plate and the cabinet and allowing the top plate to be supported by the cabinet even at the space; and an air outlet allowing internal air of the main body to be discharged through the support.

In another embodiment, a built-in cooking appliance includes a main body in which a heat source is disposed; a top plate provided above the main body; a cabinet supporting the top plate; and a support supporting the top plate, wherein the support comprises a supporting portion supporting a plurality of surfaces of the top plate and a contacting portion contacting the cabinet, according to claim, and the support supports the top plate such that the top plate is spaced apart from the cabinet to from an opening through which air passes.

In still another embodiment, a built-in cooking appliance includes a top plate; a main body disposed under the top plate; a cabinet receiving the main body; a support that is disposed under the top plate to support the top plate and has a first portion located under an under surface of the top plate and a second portion coupled to the cabinet; a first opening that is formed on the main body to allow internal fluid of the main body to be discharged out of the main body; and a second opening that is formed to allow the fluid discharged through the first opening to an external side.

In still yet another embodiment, a built-in cooking appliance includes a top plate; a main body disposed under the top plate; a cabinet receiving the main body; a top frame disposed above a space defined between at least a corner of the top plate and the cabinet to cover the space; a first fluid outlet that is formed on the main body to allow internal fluid of the main body to be discharged out of the main body; a second fluid outlet that is formed on a surface of the top frame to direct the fluid passing through the first opening into the top frame; and a third fluid outlet that is formed on the top frame to allow the fluid discharged through the second opening to an external side.

In still further yet another embodiment, a built-in cooking appliance includes a top plate; a main body disposed under the top plate and receiving a heat source; a cabinet receiving the main body; a support disposed between the top plate and the cabinet and having a first portion supporting the top plate at a rear portion of the top plate, a second portion supporting an under surface of the top plate, and a third portion coupled to the cabinet; a first opening that is formed on the main body to allow internal fluid of the main body to be discharged out of the main body; and a second opening that is formed on the cabinet to allow the fluid discharged through the first opening to an external side.

Advantageous Effects

According to the embodiments, a cooling efficiency of the cooking appliance can be improved and safety and convenience in using the cooking appliance can be improved.

BEST MODE FOR CARRYING OUT THE INVENTION

Reference will now be made in detail to the embodiments of the present disclosure, examples of which are illustrated in the accompanying drawings.

First Embodiment

Figure 1:
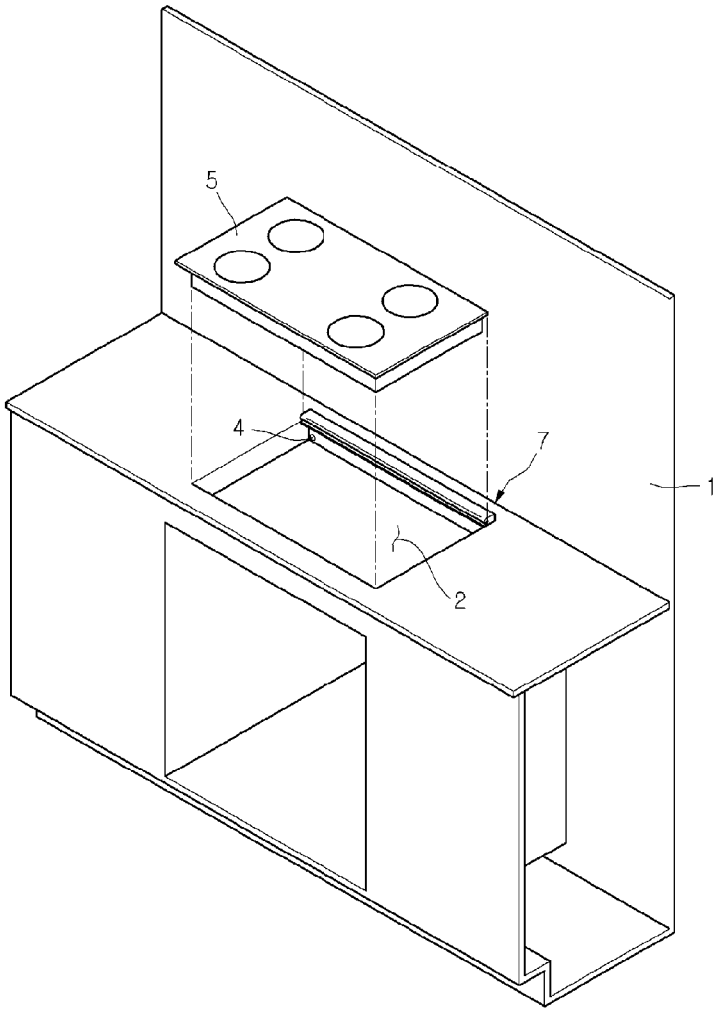
FIG. 1 is a perspective view of a built-in cooking appliance according to an embodiment, when a cooker is being installed.
Figure 2:
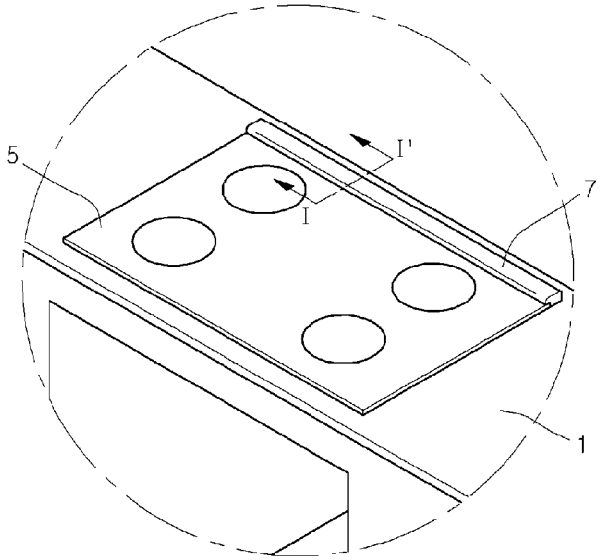
FIG. 2 is a perspective view of the built-in cooking appliance of FIG. 1, when the cooker is completely installed.

FIG. 1 is a perspective view of a built-in cooking appliance according to an embodiment, when a cooker is being installed and FIG. 2 is a perspective view of the built-in cooking appliance of FIG. 1, when the cooker is completely installed.

Referring to FIGS. 1 and 2, a built-in cooking appliance of this embodiment includes a cabinet 1 installed in a kitchen, a depressed portion 2 formed on a surface of the cabinet 1, a water outlet 4 formed through a portion of the depressed portion 2 of the cabinet 1, and a cooker 5 having a first portion received in the depressed portion 2 and a second portion seating on a top surface of the cabinet 1.

In more detail, the depressed portion 2 is depressed by a predetermined depth from the top surface of the cabinet 1 to receive the first portion of the cooker 5.

The depressed portion 2 is smaller than an area of a top surface of the cooker 5. Therefore, when the cooker 5 is received in the depressed portion 2, an edge portion of the cooker 5 seats on the top surface of the cabinet 1.

In more detail, a top plate (51 in FIG. 3) provided on an upper end of the cooker 5 seats on the top surface of the cabinet 1.

Therefore, since the top plate 51 seats on the top surface of the cabinet 1, only the top plate 51 protrudes above the top surface of the cabinet 1. Therefore, the protruding height of the cooker 5 from the cabinet 1 can be minimized.

When the cooker 5 is installed on the cabinet 1, a rear end portion of the top plate 51 does not seat on the top surface of the cabinet 1. That is, since a space through which internal hot air of the cooker 5 is discharged must be formed between a rear end portion of the cooker 5 and the cabinet 1, the rear end portion of the top plate 51 does not seat on the top surface of the cabinet 1 but is spaced apart from the top surface of the cabinet 1.

That is, if the rear end portion of the top plate 51 seats on the cabinet 1, no space through which the internal heat of the cooker 5 is formed. Therefore, the rear end portion of the top plate 51 must be spaced apart from the top surface of the cabinet 1. At this point, the rear end portion of the top plate 51 is supported by a support 7 installed on the cabinet 1.

As the top plate 51 seats on the cabinet 1 as described above, a dishware can be stably set on the top surface of the top plate 51. In addition, since only the top plate 51 protrudes above the top surface of the cabinet 1, an outer appearance of the cooking appliance can be improved.

Meanwhile, although a bottom of the depressed portion 2 is closed, air may be introduced into the depressed portion 2 through other clearances of the cabinet and the introduced air may be directed into the cooker 5.

Further, the water outlet 4 may be formed right under a passage along which the water flows down from the cooker 5. If the bottom of the depressed portion 2 is inclined, the water outlet 4 is formed on a lowest portion of the inclined bottom of the depressed portion 2.

Figure 3:
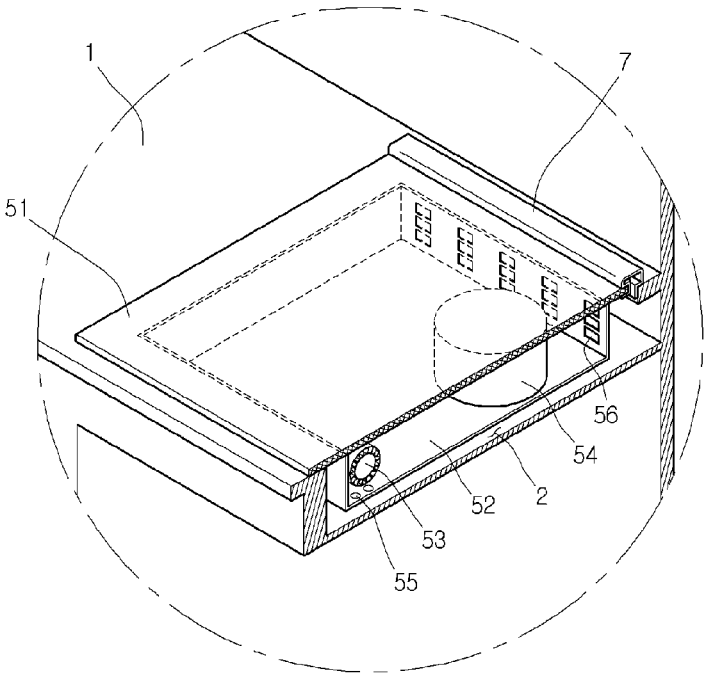
FIG. 3 is a partly broken perspective view of the built-in cooking appliance of FIG. 1.
Figure 4:
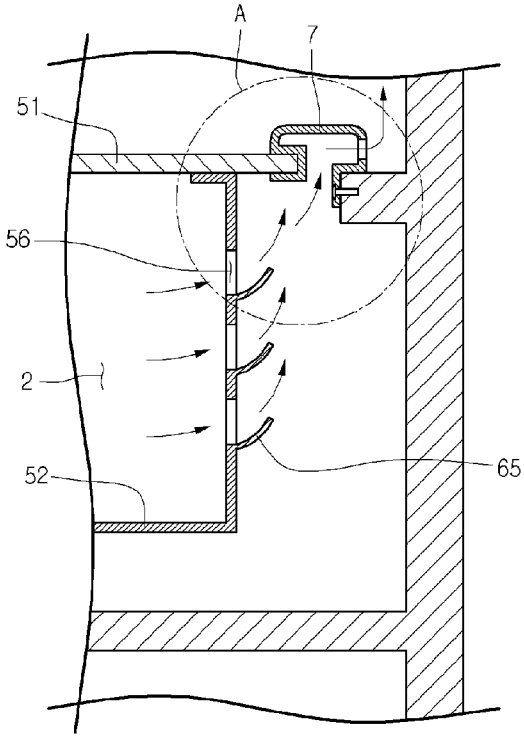
FIG. 4 is a sectional view taken along line I-I' of FIG. 2.
Figure 5:
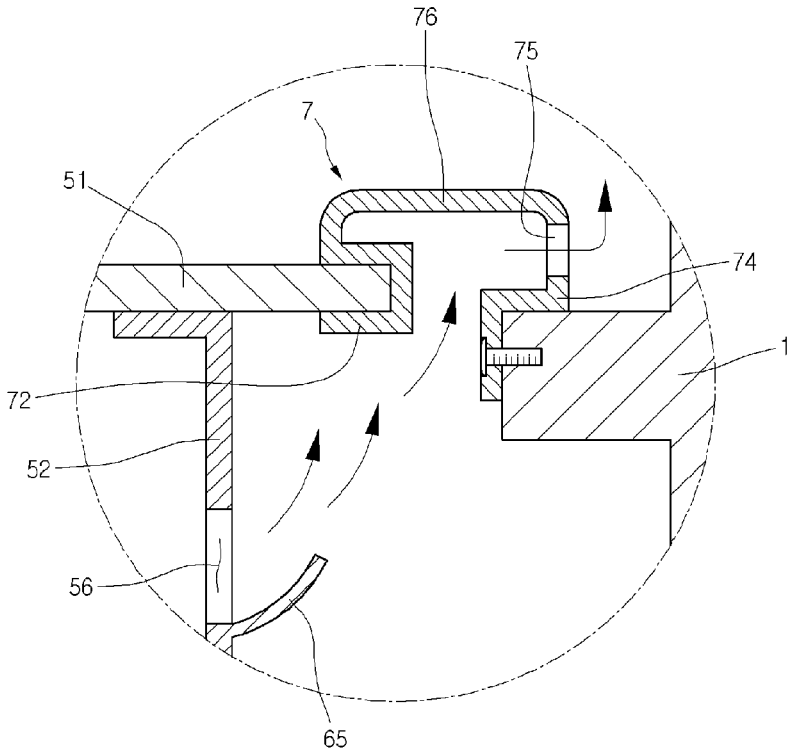
FIG. 5 is an enlarged view of a portion A of FIG. 4.

FIG. 3 is a partly broken perspective view of the built-in cooking appliance of FIG. 1, FIG. 4 is a sectional view taken along line I-I' of FIG. 2, and FIG. 5 is an enlarged view of a portion A of FIG. 4.

Referring to FIGS. 3 through 5, the cooker 5 includes a top plate 51 functioning as a support plate on which a dishware is located and a main body 52 disposed under the top plate 51.

An outer appearance of the main body 52 is defined by a body frame. A heater 54 for generating heat and a fan 53 for discharging the hot air out of the main body 52 are installed in the main body 52. Any types of heaters such as a direct heating type or an induction heating type may be used as the heater.

As described above, since front and side edge portions of the top plate 51 seat on the top surface of the cabinet 1, only the top plate 51 protrudes above the cabinet 1.

On the other hand, the rear edge portion of the top plate 51 is supported by the support 7 installed on the cabinet 1. In more detail, the support 7 seats on the cabinet 1 and is coupled to a surface defining the depressed portion 2 of the cabinet 1. The coupling of the support may be realized by a coupling member or adhesive. However, the present invention is not limited to this configuration.

Here, it may be understood that a space through which the hot air is discharged is eliminated by the support 7. However, in this embodiment, an airflow hole formed by the support 7 functions as the space.

The following will describe the support 7 in more detail.

The support 7 includes a supporting portion 72 supporting the rear edge portion of the top plate 51, a coupling portion 74 coupled to the cabinet 1, and a connecting portion 76 connecting the supporting portion 72 to the coupling portion 74.

In more detail, a section of the supporting portion 72 is formed in a □-shape to support the top plate 51. Further, by the shape of the supporting portion 72, the rear edge portion of the top plate 51 is partly inserted in the supporting portion 72.

At this point, the supporting portion 72 supports at least one of two corresponding surfaces (top and bottom surfaces) of the top plate 51. That is, the supporting portion 72 is provided with a space in which the top plate 51 is partly inserted. When the space of the supporting portion 72 is higher than the top plate 51, one of the two corresponding surfaces of the top plate 51 closely contacts the supporting portion 72. At this point, the top surface of the top plate 51 closely contacts the supporting portion 72 so as to prevent foreign objects from being introduced through a space defined between the top plate 51 and the supporting portion 72. Preferably, at least three surfaces of the top plate 51 are supported by the supporting portion 72. Namely, as shown in FIG. 5, a bent plate is provided and three surfaces of the bent plate contact the top plate 51 to stably support the top plate 51.

Since at least front and both side edge portion of the top plate 51 are supported on the top surface of the cabinet 51, the top plate 51 can be stably supported on the cabinet 51 even when the rear edge portion of the top plate 51 is not supported by the supporting portion 72. However, in order to more stably support the top plate 51, the supporting portion 72 may further support the top and bottom surfaces at the side surfaces.

Meanwhile, the coupling portion 74 is located at a portion that is spaced away from the supporting portion 72 in a state where the support 7 seats on the cabinet 1 to define a passage along which the air is discharged from the main body 52 to the external side.

Meanwhile, the connecting portion 76 connects gently the supporting portion 72 to the coupling portion 74. The connecting portion 76 protrudes above the top plate 51 by a predetermined height. Therefore, when the dishware slides rearward, the sliding of the dishware is stopped by the connecting portion 76.

Only the connecting portion 76 of the support 7 is exposed to the external side. Therefore, it can be understood that the connecting portion 76 further functions as an interior function screening the supporting portion 72 and the coupling portion 74. A clearance is defined between the top plate and the cabinet by the support 7 and the connecting portion functions as a top frame covering the clearance.

The following will describe an installing process of the cooker 5.

First, the support 7 is installed on the cabinet 1. At this point, the support 7 is installed at a location where the rear portion of the cooker 5 is supported. That is, after the coupling portion 74 seats on the cabinet 1, the support 7 is coupled to the cabinet 1 by a coupling member.

In this state, a lower portion of the cooker 5, i.e., the main body 52 of the cooker 5, is inserted into the depressed portion 2. Then, the front and both side edges of the top plate 51 seats on the cabinet 1. Next, the cooker 5 is pushed rearward. Then, the rear edge portion of the top plate 51 is inserted in the supporting portion 72, thereby completing the installation of the cooker 5.

The following will describe an airflow process for cooling the inside of the cooker 5.

First, when the fan 53 operates, cool air is introduced into the cooker 5. The cool air may be introduced through an air inlet formed on a bottom of the main body 52 aligned with the fan 53.

The cool air introduced through the air inlet 55 may be sucked through the clearance of the cabinet 1, which is formed on a front portion of the depressed portion 2. Needless to say, when the bottom of the depressed portion 2 is formed having an opening, the cool air may be sucked through the bottom of the depressed portion 2.

The air sucked by the fan 53 is discharged through an air outlet 56 formed on the rear portion of the main body 52 via a control unit (not shown) and the heater 54. The air discharged through the air outlet 56 is discharged to the external side through the airflow hole 75.

In order not to direct the air discharged through the air outlet 56 to other spaces in the depressed portion 2 but to the airflow hole 75, an airflow guide 65 may be further formed on a rear portion of the main body 1.

The following will describe relationship between fluid around the cooker 5 and this embodiment.

First, since the cooker 5 is installed in a place such as the kitchen where the water is frequently used, it must be considered to prevent the water from flowing into the cooker 5. To realize this, the bottom surface of the top plate 51 and the surface of the cabinet 1 are sealed together at front and both sides of the top plate 51 by a sealing member. Therefore, only the top frame 6 on which the opening 61 is formed is a weak point through which the external fluid may be introduced into the cooker 5.

That is, the water may be introduced into the cooker 5 through the opening 61. However, since the water introduced into the cooker 5 flows downward through the airflow hole 77 formed on the support 72, the water is not directed into the main body 52.

In more detail, the airflow hole 77 of the support 7 functions as a passage allowing the water introduced from the external side to flow downward without being introduced into the main body 52 while functioning as a passage along which the air discharged from the main body 52 flows.

The water flowing downward may be discharged to the external side through the water outlet 4 or vaporized by the heat generated by the cooker.

The following will describe a modified example of this embodiment.

First, when the depressed portion 2 is closed, the water outlet 4 functions to discharge the water collected in the depressed portion 2 to the external side. When the depressed portion 2 is not closed but opened, a water collecting unit may be provided under the depressed portion 2 to collect the water flowing downward from the cooker and discharge the collected water to the external side.

The top frame may be designed having a first side fixed on the cabinet 1 and a second side spaced apart from the top surface of the top plate. In this case, a front opening is defined between the top plate and the top frame so that the air can pass through the front opening.

In this case, since the air discharged from the space to the external side is divided into two ways, the airflow efficiency can be improved while the airflow resistance is reduced. Further, noise generated by the flowing air can be reduced.

Furthermore, the air discharged through the front opening can quickly dissipate the high heat of the top surface of the top plate while flowing along the top surface of the top plate. Therefore, as using the cooker, the heat remained on the top plate can be quickly dissipated. This enhances the safety in using the cooker.

Needless to say, when the cooker starts operating in a state where the dishware is located on the top plate, the air discharge through the front opening may dissipate the heat transmitted from the top plate to the dishware. In this case, since the top plate, however, closely contacts the dishware, the air cannot flows into the contact portion between the top plate and the dishware. Therefore, the heat dissipation problem is not serious. In addition, by designing the front opening and the rear opening with an optimal size ratio, the deterioration of the heat efficiency can be prevented while providing the safety in using the cooker.

The following will describe an airflow process for cooling the inside of the cooker 5.

First, when the fan 53 operates, cool air is introduced into the cooker 5. The cool air may be introduced through an air inlet formed on a bottom of the main body 52 aligned with the fan 53.

The cool air introduced through the air inlet 55 may be sucked through the clearance of the cabinet 1, which is formed on a front portion of the depressed portion 2. Needless to say, when the bottom of the depressed portion 2 is formed having an opening, the cool air may be sucked through the bottom of the depressed portion 2.

The air sucked by the fan 53 is discharged through an air outlet 56 formed on the rear portion of the main body 52 via a control unit (not shown) and the heater 54. The air discharged through the air outlet 56 is directed to the space defined between the support 7 and the top frame 6 through the airflow hole 77. The air directed to the space is discharged through the opening 61 of the top frame 6.

In order not to direct the air discharged through the air outlet 56 to other spaces in the depressed portion 2 but to the air flow hole 75, an airflow guide 65 may be further formed on a rear portion of the main body 1.

In the drawing, although a plurality of the airflow guides 65 are formed corresponding to a plurality of holes of the air outlet 56, only one airflow guide 65 extending toward the airflow holes 75 may be provided.

As described above, since the airflow holes 77 is formed on the support 7 and the opening is formed on the top frame 6, the hot air in the cooker 5 can be discharged to the external side through the airflow hole 77 and the opening 61.

The following will describe relationship between fluid around the cooker 5 and this embodiment.

First, since the cooker 5 is installed in a place such as the kitchen where the water is frequently used, it must be considered to prevent the water from flowing into the cooker 5. To realize this, the bottom surface of the top plate 51 and the surface of the cabinet 1 are sealed together at front and both sides of the top plate 51 by a sealing member. Therefore, only the support 7 on which the air flow hole 75 is formed is a weak point through which the external fluid may be introduced into the cooker 5.

That is, the water may be introduced into the cooker 5 through the air flow hole 75. However, since the water introduced into the cooker 5 flows downward along the space defined between the support 72 and the coupling portion 74, the water is not directed into the main body 52.

In more detail, the clearance between the coupling portion 74 and the supporting portion 72 functions as a passage allowing the water introduced from the external side to flow downward without being introduced into the main body 52 while functioning as a passage along which the air discharged from the main body 52 flows.

The water flowing downward may be discharged to the external side through the water outlet 4 or vaporized by the heat generated by the cooker.

Figure 6:
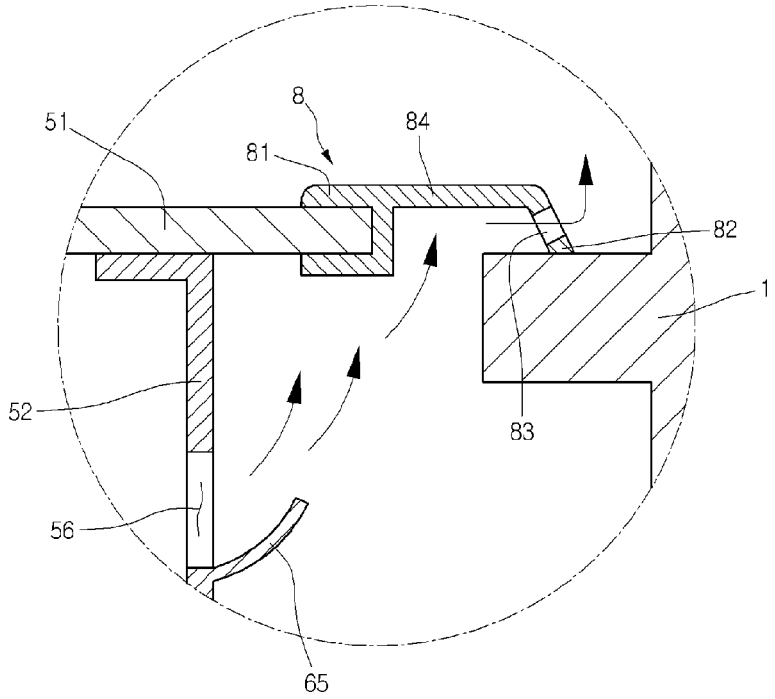
FIG. 6 is a partial sectional view of a modified example of the built-in cooking appliance of the first embodiment.

FIG. 6 is a partial sectional view of a modified example of the built-in cooking appliance shown in FIGS. 1 through 5.

Only different features from the foregoing embodiment will be described with reference to FIG. 6.

Referring to FIG. 6, a support 8 includes a supporting portion 81 supporting a rear edge portion of a top plate 51, a seating portion 82 seating on a cabinet 1, and a connecting portion 84 for connecting the support 82 to the seating portion 82. The seating portion 82 is provided with an air flow hole 83 through which the air can be discharged.

That is, in this modified example, the seating portion 82 is not coupled to the cabinet 1 but simply seats on the cabinet 1. Therefore, a structure for coupling the support 8 to the cabinet 1 is omitted and thus the structure of the support 8 can be simplified. Furthermore, since there is no need to perform a process for coupling the support 8 to the cabinet, the installing process of the cooker 5 can be simplified and quickly performed.

Second Embodiment

According to feature of the first embodiment, the support supports a corner of the top plate while allowing the air to flow to the external side. The following will describe another embodiment of the top frame.

Figure 7:
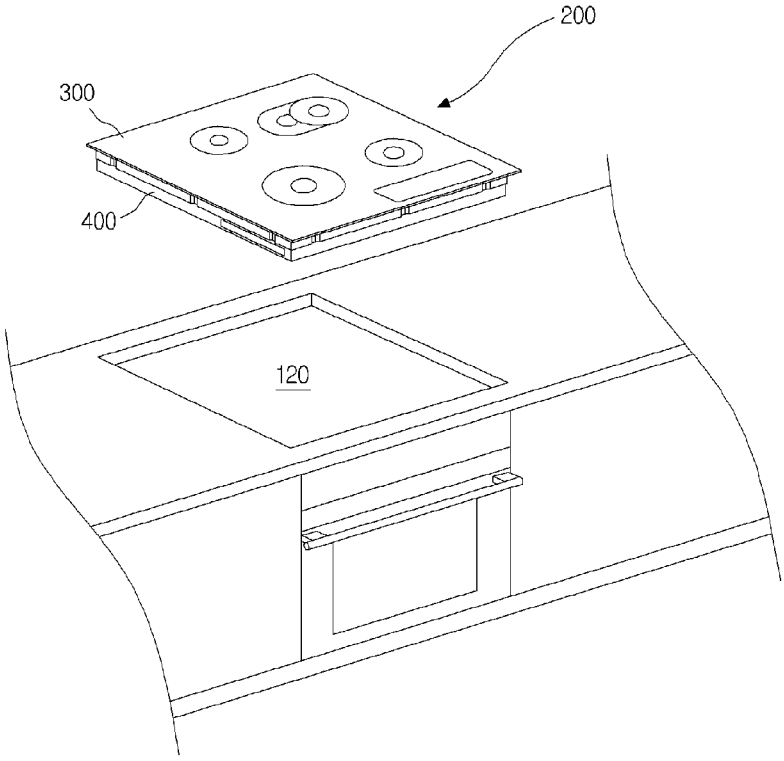
FIG. 7 is a view of a built-in cooking appliance according to a second embodiment, when a cooker is being installed.

FIG. 7 is a view of a built-in cooking appliance according to a second embodiment, when a cooker is being installed.

Referring to FIG. 7, a cabinet 100 is provided in a kitchen. A receiving portion 120 defining an inner space of the cabinet 100 and depressed downward to provide a space for receiving at least a portion of a cooker is formed on the cabinet 100. The cooker is partly received in the receiving portion 120.

The cooker is a part of the cabinet 100 and may be received together with a microwave oven.

When the cooker is partly received in the receiving portion 120, a top plate 200 defining a front outer appearance of the cooker is supported by the cabinet 100. The receiving portion 120 may be provided with a seating portion on which the top plate 200 seats. The seating portion is stepped along the upper end edge of the receiving portion 120 to support an edge of an under surface of the top plate 200.

That is, the seating portion is depressed at the edge portion of the receiving portion 120 by a depth that may vary in accordance with an installing method of the cooker.

When the top plate 200 is installed protruding above a top surface of the cabinet 100, there is no need to form the seating portion or a depth of the seating portion is very narrow. When the top plate 200 is installed to be lower than the top surface of the cabinet 100, the seating portion is depressed by a depth greater than a thickness of the top plate 200.

When the top plate 200 seats on the seating portion, front and both side edges of the top plate 200 are supported by the seating portion. Meanwhile, a rear edge portion of the top plate 200 is not supported to form a clearance through which the hot air generated in the cooker can be discharged to an external side.

Figure 8:
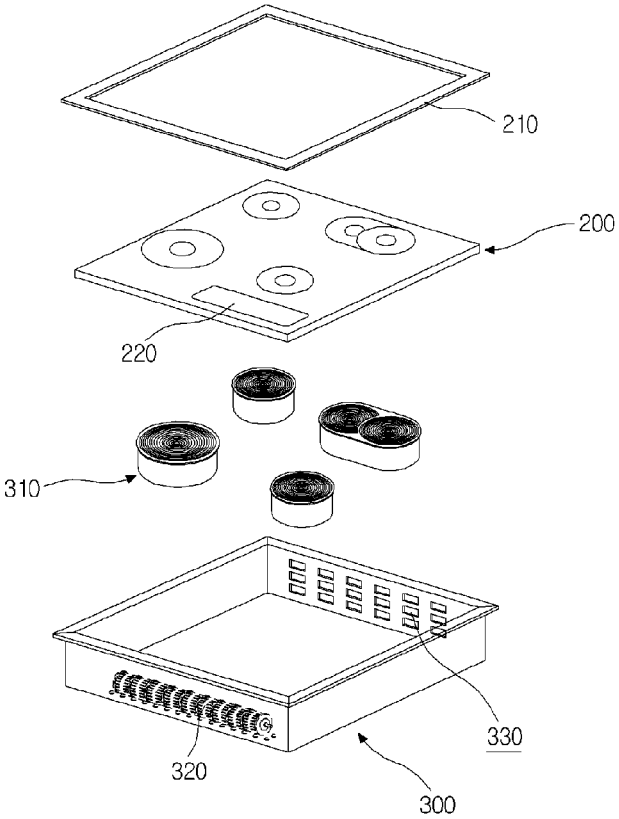
FIG. 8 is a schematic exploded perspective view of the built-in cooking appliance of FIG. 7.
Figure 9:
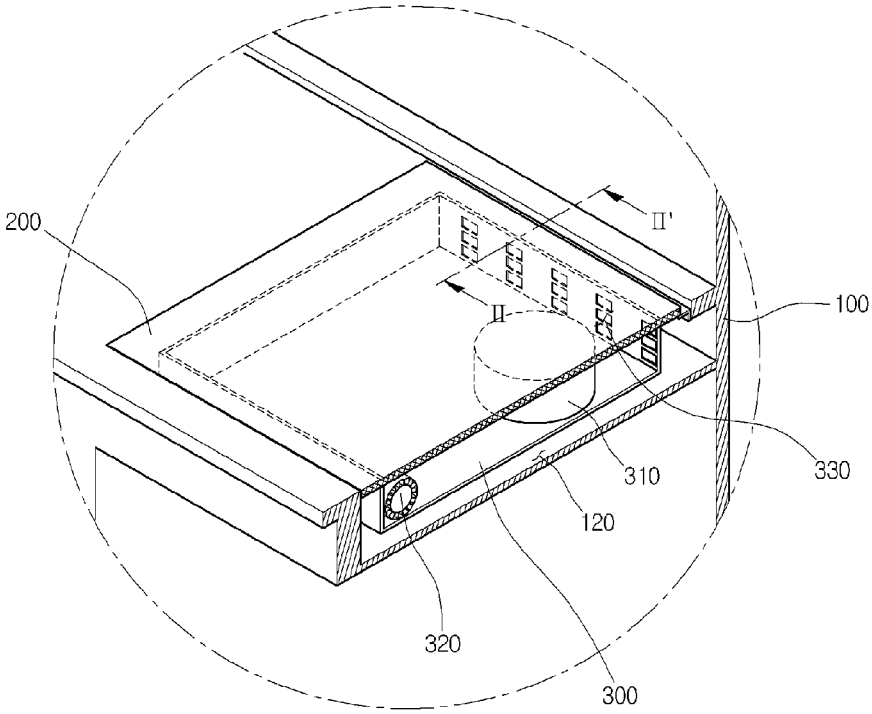
FIG. 9 is a partly broken perspective view of the built-in cooking appliance of FIG. 7.

FIG. 8 is a schematic exploded perspective view of the built-in cooking appliance of FIG. 7 and FIG. 9 is a partly broken perspective view of the built-in cooking appliance of FIG. 7.

Referring to FIGS. 8 and 9, the top plate for defining the top outer appearance of the cooker and supporting directly or indirectly a dishware is provided on an upper end of the cooker. An inner space is defined on a lower portion of the top plate 200 and a main body 300 in which a plurality of components are mounted is provided in the inner space. An overall appearance of the cooker is defined by the top plate 200 and the main body 300.

The top plate 200 is formed of a rectangular tempered glass plate having a predetermined thickness so that it can endure the heat generated from a heat source installed in the main body 300.

The top plate 200 is supported by the seating portion depressed on the edge portion of the receiving portion 120 or by a top surface of the cabinet 100. In this embodiment, the bottom surface of the top plate 200 is supported by the seating portion so that the top surface of the top plate 200 and the top surface of the cabinet 100 can be located at an identical horizontal plane. However, the present invention is not limited to this configuration.

A top frame 210 is mounted between the edge of the top plate 200 and the top surface of the cabinet 100. Therefore, a space between the edge of the top plate 200 and the top surface of the cabinet 100 is shielded by the top frame 210. At this point, even when a clearance between the edge of the top plate 200 and the top surface of the cabinet 100 is slightly formed or not, the top frame 210 is mounted to discriminate between the top surface of the top plate 200 and the top surface of the cabinet 100. Furthermore, the top frame 100 is not installed at a portion through which the internal hot air is discharged, i.e., between the rear portion of the top plate 200 and the cabinet 100. Even if the top frame 100 is installed between the rear portion of the top plate 200 and the cabinet 200, an air outlet for discharging the hot air is formed. At this point, the main body 300 and the cabinet 100 are spaced apart from each other by a predetermined clearance under the top frame installed between the rear portion of the top plate 200 and the cabinet 100. The air or water can flow through the clearance.

A location where the dishware will be located is marked on a top-front end portion of the top plate 200 so that a user can dispose the dishware at an accurate location. A manipulation unit 220 allowing the user to manipulate the cooker is provided on the top-front end portion of the top plate 200.

According to this embodiment, the top surface of the top plate 200 and the top surface of the cabinet 100 are located on the identical horizontal plane, thereby improving the outer appearance of the cooker.

At least one heater 310 generating heat used for cooking food and a fan 320 that forcedly discharge the internal hot air of the main body 300 out of the main body 300 to cool the inside of the main body 300 are installed in the main body 300. Any types of heaters such as a direct heating type, an indirect heating type, and a combination thereof may be used as the heater 310.

When it is assumed that a location where the user is located is a front portion, a rear end portion of the top plate 200 located above the main body 300 is located closer to the front portion than the rear surface of the receiving portion 120. That is, a front-rear length of the top plate 200 is less than a front-rear length of the receiving portion 120 to define a predetermined space between the rear surface of the top plate 200 and the rear end portion of the receiving portion 120.

The top plate 210 is mounted above the space defined between the rear end portion of the top plate 200 and the rear end portion of the receiving portion 120 to shield the space between the top plate 200 and the cabinet 100.

A support supporting the top plate 200 is provided between the rear surface of the top plate 200 and the cabinet 100. The support 400 is formed of a rectangular plate having a predetermined thickness. A portion of the support 400, which is coupled to the cabinet 100, is bent in a lateral direction to provide a surface coupled to the cabinet 100.

The support 400 has a first end portion located under the top plate 200 to support the top plate 200 and a second end portion coupled to the cabinet 100 by a coupling member such as a screw, thereby preventing the top plate 200 from being separated downward.

Figure 10:
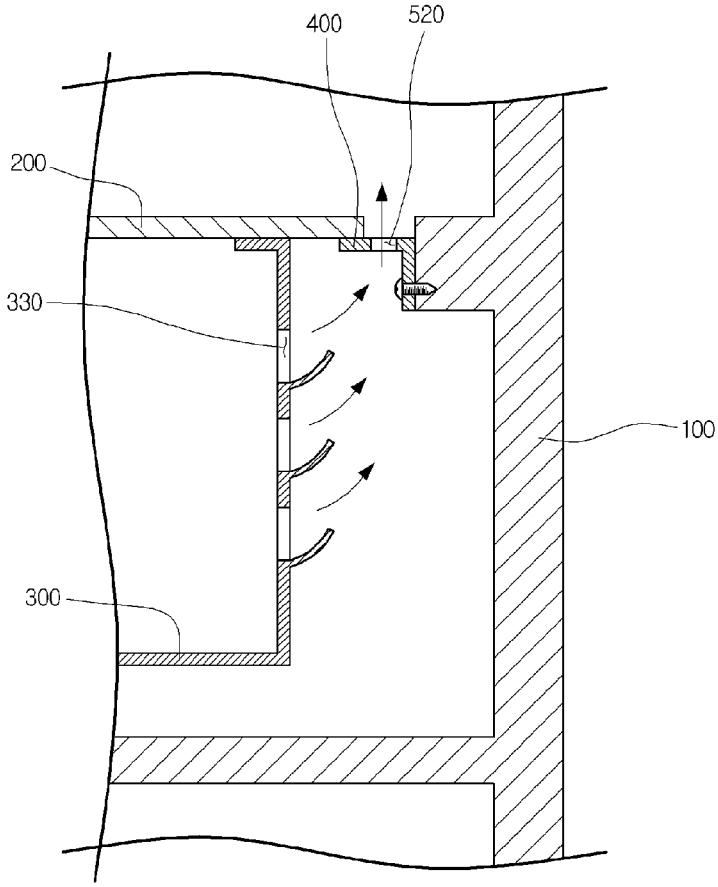
FIG. 10 is a sectional view taken along line II-II' of FIG. 9.

FIG. 10 is a sectional view taken along line II-II' of FIG. 9.

Referring to FIG. 10, the support 40 is formed of a plate having a predetermined thickness. A rear half of the support 40 is bent downward to have a □-shape when viewed from a right side. A plurality of the supports 400 are mounted and spaced apart from each other by a predetermined distance to support the top plate 200. Alternately, only one support 400 may be mounted to support the top plate 200.

The support 400 has a horizontal section formed by the rear half bent downward and partly located under the top plate 200 to support the top plate 200 and a vertical section coupled to the cabinet 100.

The horizontal section of the support 400 supports the under surface of the top plate 200. The vertical section integrally formed with the horizontal section is coupled to the vertical section of the cabinet 100 by a screw. The vertical section of the support 400 is provided with a screw hole through which the screw coupled to the vertical section of the cabinet 100 penetrates. The screw hole is formed in an oval shape to enable the height of the support 400 to be adjusted.

The screw hole may be multi-stepped to adjust the support 400 by a predetermined range. That is, supporting protrusions are formed on an inner circumference of the screw hole to support the screw. A plurality of the screw holes may be formed along a vertical line so that the screw can be screwed through one of the screw hole corresponding to the position of the support 400.

When the height of the support 400 is adjusted as described above, the inclination and position of the top plate 200 supported by the support 400 can be accurately adjusted.

The support 400 may be coupled to the cabinet 100 by a variety of means such as an adhesive, screw, hook member, and the like. In this embodiment, the screw is used by way of example.

When the support 400 is coupled to the cabinet 100 to support the top plate 200, the downward separation of the top plate 200 from the receiving portion 120 can be prevented.

The following will describe a process for discharging the internal hot air out of the main body.

The hot air (including other fluids) generated in the internal space of the main body 300 is provided with a first opening 330 through which the hot air is discharged out of the main body 300.

In this embodiment, the first opening 330 is formed on a rear surface of the main body 300 to discharge the hot air generated in the internal space of the main body 300 toward the vertical section of the cabinet 100. The first opening 330 may be formed on a side surface of the main body.

Meanwhile, the support 400 is provided at the horizontal section with a second opening 520 through which the hot air passing through the first opening 330 is discharged to the external side.

The second opening 520 is not limited to a specific shape as long as it can discharge the hot air. For example, the second opening 520 may be formed in an oval shape extending in a horizontal direction or in a slit shape. The second opening 520 may be formed with a plurality of holes. When a plurality of the supports 400 are mounted, a gap between the supports 400 may define the second opening 520.

When the second opening 520 is formed on the horizontal section of the support 400, the second opening 520 is located between the rear end portion of the top plate 200 and the vertical section of the cabinet 100.

The following will describe a corresponding structure to a case where the water overflows on the top surface of the cooker.

First, a contact surface between the under surface of the top plate 200 and a portion of the receiving portion 120 on which the top plate seats is sealed by a sealing member at the front and both side portions of the top plate 200. Therefore, the fluid cannot flow from the external side into the main body 300. However, the external fluid may inflow through the rear edge portion of the top plate.

The fluid inflowing through the space defined between the rear edge portion of the top plate 200 and the cabinet 100 falls down through the second opening 520. The water falling down through the opening 520 is discharged out of the cabinet 100 through an outlet formed in the cabinet 100 located under the receiving portion 120. To realize this, the rear end portion of the top plate 200 is spaced apart from the cabinet 100 by a predetermined distance and a sectional area of the main body 300 located under the top plate 200 is less than that of the top plate 200. Therefore, the water falling down through the second opening cannot be introduced into the main body 300.

In addition, a top frame is further provided above the support 400 and the top frame is provided with a small hole through which the water flows, thereby more reliably obstructing the inflow of the external water. At this point, the top frame of this embodiment is slightly different from the top frame of the first embodiment. That is, the top frame does not function as a support but as a cover covering the space formed by the support.

FIGS. 11 through 14 are views of modified examples of the built-in cooking appliance of the second embodiment.

Figure 11:
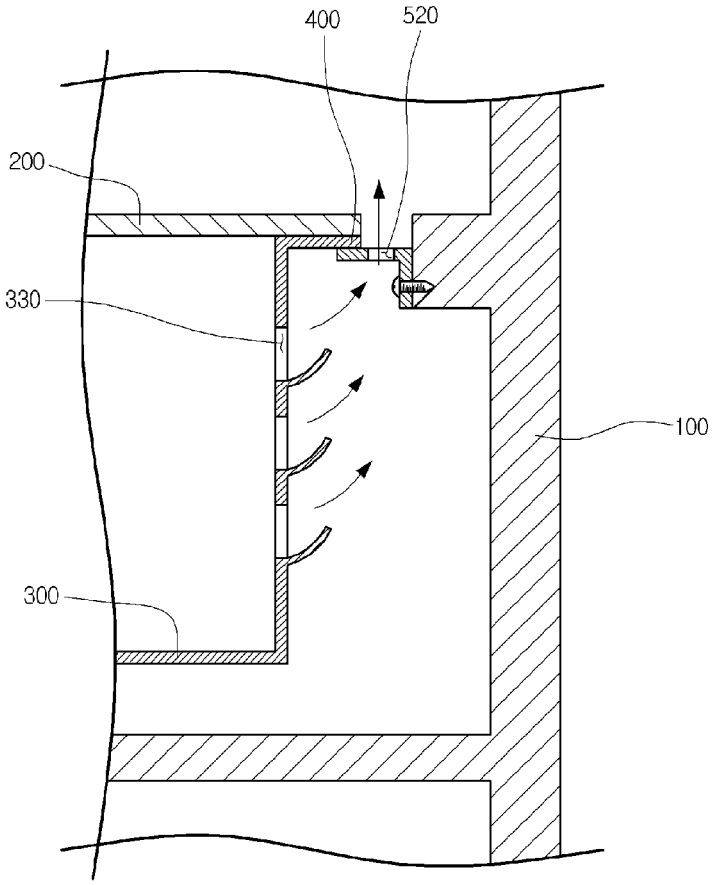
FIGS. 11 through 14 are views of modified examples of the built-in cooking appliance of the second embodiment.

In a modified example of FIG. 11, a supporting method for supporting a top plate 200 using a support 400 is modified. In more detail, an edge portion of the main body 300 is bent outward and fixed on an under surface of the top plate 200. The support 400 is fixed on an under surface of the edge portion of the main body.

Figure 12:
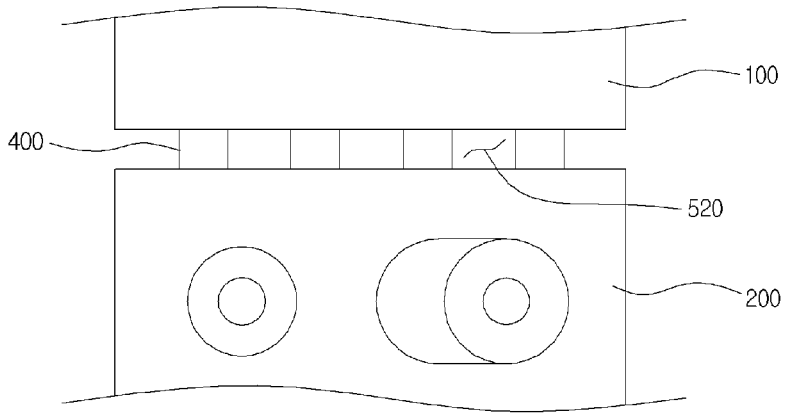
Figure 13:
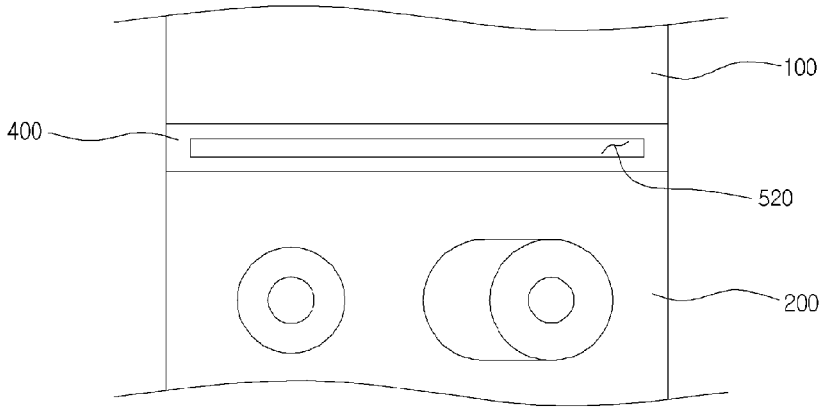
Figure 14:
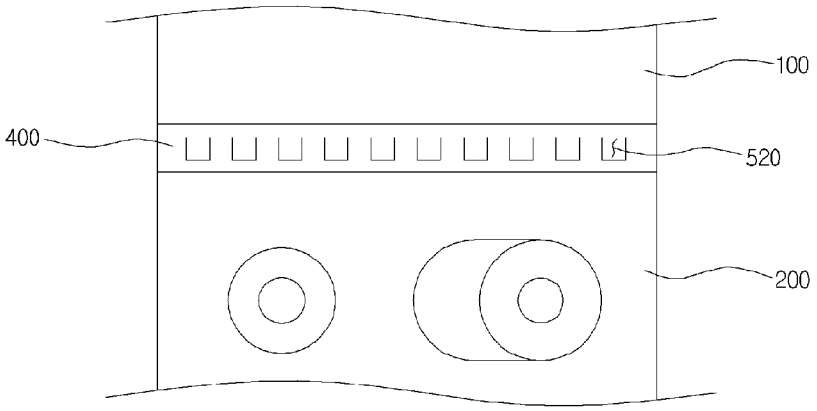

FIGS. 12 through 14 show modified examples of the second opening 520 provided on the support. In FIG. 12, a plurality of the supports are provided and the second opening 520 is defined between the supports. In FIG. 13, a single second opening 520 is formed in an oval shape in the single support. In FIG. 14, a plurality of the second openings 520 is formed in the single support.

Third Embodiment

In the first and second embodiments, a large air outlet is provided on the support or the top frame. In this case, the water may be introduced from the external side into the main body. This may cause the malfunction of the cooker. This third embodiment is for solving the problem. Only the different parts will be described in this embodiment.

A top frame 210 is mounted above a space defined between a rear end portion of the top plate 200 and a rear end portion of a receiving portion. According to a feature of this embodiment, the top frame 210 is designed to discharge the internal hot air of the main body 300 in a side direction.

Figure 15:
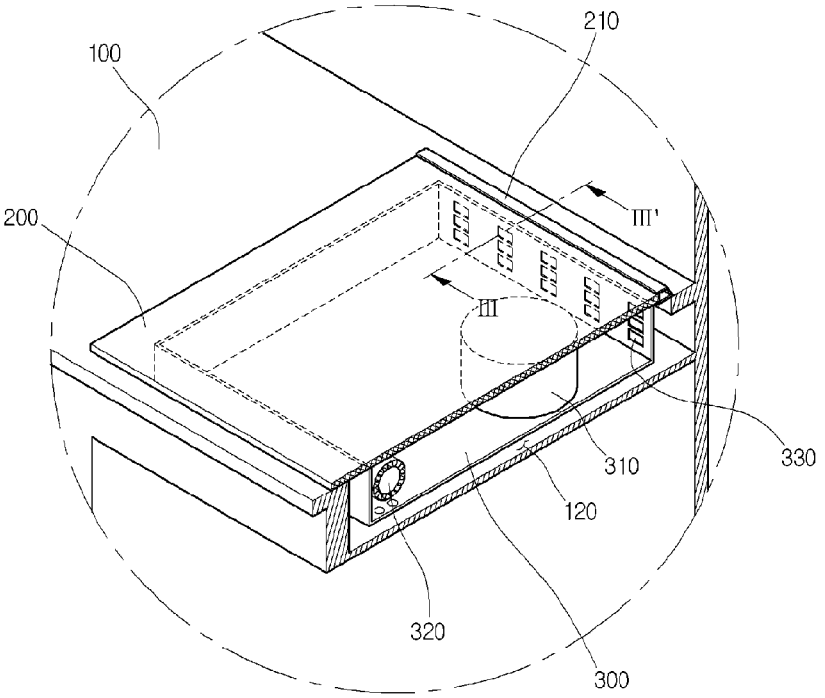
FIG. 15 is a partly broken perspective view of a built-in cooking appliance according to a third embodiment.
Figure 16:
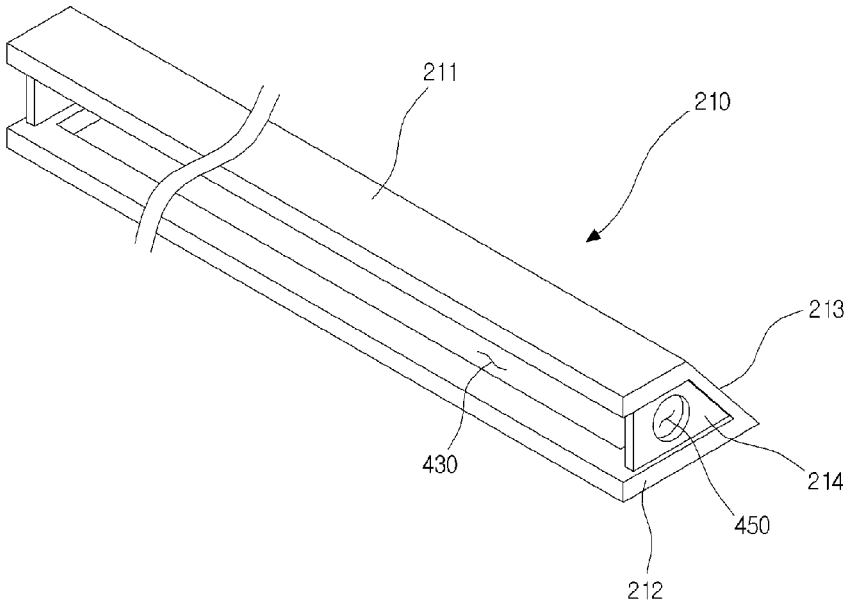
FIG. 16 is a perspective view of a top frame shown in FIG. 15.

FIG. 15 is a partly broken perspective view of a built-in cooking appliance according to a third embodiment and FIG. 16 is a perspective view of a top frame shown in FIG. 15.

Referring to FIGS. 15 and 16, the top frame 210 functions as a cover for covering a space defined between a rear corner of the top plate 200 and the cabinet 100. The top frame 210 includes a top panel 211 defining a top outer appearance, a bottom panel 212 defining a bottom outer appearance, a rear panel defining a rear outer appearance, and side panels 214 defining a side outer appearance.

The top panel 211 is formed of a rectangular panel having a predetermined thickness and extending in a horizontal direction. The rear panel 213 is formed by being bent at a rear end portion of the top panel 211. The rear panel 213 is inclined rearward as it goes downward. The rear panel 213 is formed of a rectangular panel having a predetermined thickness and extending in a horizontal direction. The bottom panel 212 is formed by being bent frontward at a lower end portion of the rear panel 213. The bottom panel 212 is formed of a rectangular panel having a predetermined thickness and extending in a horizontal direction. The bottom panel 212 is larger than the top panel 211.

The side panels 214 are disposed between the top and bottom panels 211 and 212. Each of the side panels 214 is formed of a rectangular plate having a predetermined thickness. A right surface of each of the side panels 214 is inclined rearward at it goes downward.

A front end portion of each of the side panels 214 is located behind front end portions of the top and bottom panels 211 and 213. A length of the top surface of the side panel 214 is less than a front-rear length of the top panel 211. A length of the bottom surface of the side panel 214 is less than a front-rear length of the bottom panel 212. In this state, when the rear surface of the side panel 214 is located on a same plane as the rear surface of the rear panel 213, the front end portion of the side panel 214 is located behind the front end portions of the top and bottom panels 211 and 213.

A distance between the under surface of the top panel 211 and the top surface of the bottom panel 212 corresponds to the thickness of the top plate 200. Therefore, a height of the side panel 214 is set to correspond to the thickness of the top plate 200. Furthermore, a left-right length of the top panel 211 and a left-right length of the bottom panel 212 are set to correspond to a left-right length of the top plate 200.

The top frame has an opened front portion. The rear end portion of the top frame 210 is inserted into the top frame 210 through the opened front portion. When the top late 200 is inserted between the top and bottom panels 211 and 212, the front end of the top frame 210 supports an opposing surface of the top plate 200 and the front surface of the side panels 214 support the rear surface of the top plate 200.

As a feature of this embodiment, the bottom panel 212 of the top frame 210 is provided with a second air outlet 430 through which the hot air discharged through the first air outlet 330 is introduced into an inner space of the top frame 210. The hot air introduced into the top frame 210 through the second air outlet 430 is discharged through third air outlets 450 formed on the side panels 214.

By the above-described structure, the air is discharged to the external side through the air outlets formed on both side surfaces of the top frame 210. In this case, an area through which the water inflows from the external side is small. Therefore, the malfunctioning of the cooker, which is caused by the water, can be prevented.

Figure 17:
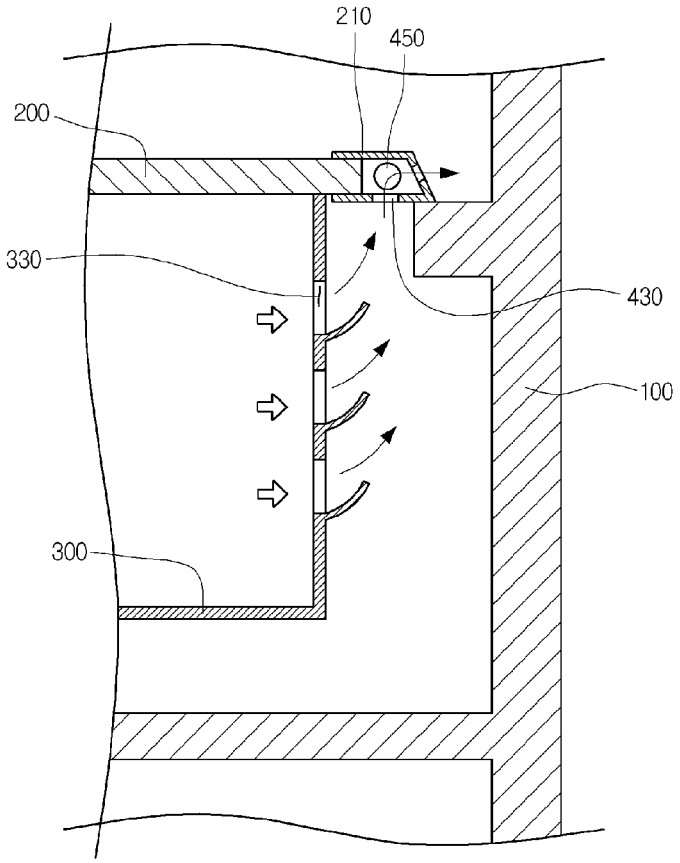
FIG. 17 is a sectional view taken along line III-III' of FIG. 5.

FIG. 17 is a sectional view taken along line III-III' of FIG. 5.

The following will describe operation of this third embodiment with reference to FIG. 17.

An air outlet 330 is formed on the rear surface of the main body 300 to discharge the hot air generated by a heater 310 mounted in the main body 300 out of the main body 300.

The first air outlet 330 may be formed on both side surfaces, a front surface or an under surface of the main body 300. In this case, the air discharge efficiency, however, is deteriorated. Therefore, the first air outlet 330 is preferably formed on the rear surface of the main body 300. Alternatively, the first air outlet 330 may not be formed. In this case, a special passage is formed to discharge the hot air out of the main body.

As described above, when the first air outlet 330 is formed on the main body 300, the hot air generated in the main body 300 flows out of the main body 300, i.e., toward a space between the main body 300 and the cabinet, through the first air outlet 330.

The hot air flows toward the space between the rear surface of the main body 300 and the cabinet 100 flows upward by a convection current phenomenon. The air flowing upward is directed to the top frame 210.

Meanwhile, the top frame 210 is provided with a second air outlet 430 through which the air passing through the first air outlet 330 is directed into the top frame 210. Each of the side panels 214 defining the both side surfaces of the top frame 210 is provided with a third air outlet 450 so that the air can be discharged to the external side through the both side surfaces of the top frame 210.

The third air outlet 450 is formed behind a rear surface of the top plate 200 supported by a front end portion of the top frame 210. In addition, the second air outlet 430 may be formed in an oval shape a rectangular shape extending in a horizontal direction on each of the side panels 214.

Figure 18:
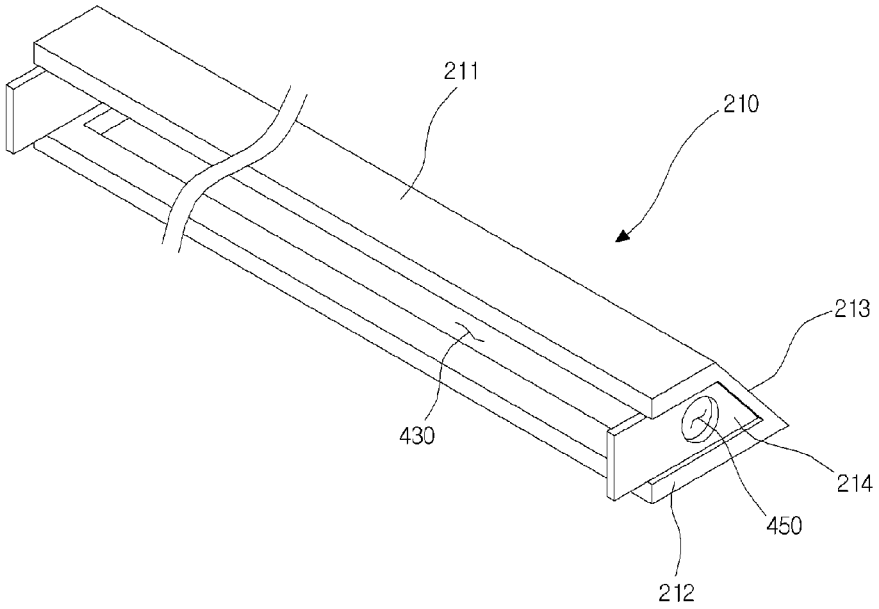
FIG. 18 is a perspective view of a modified example of the top frame of FIG. 16.

FIG. 18 is a perspective view of a modified example of the top frame.

Referring to FIG. 18, the front-rear length of the side panel 214 is greater than front-rear lengths of the top and bottom panels 211 and 212. The left and right side surfaces of the top plate 200 are supported by the side panels 214. By this structure, the relative position between the top plate 200 and the top frame 210 can be accurately set.

The panels of the top frame 210 may be formed by independent members that are assembled with each other. Alternatively, the panels of the top frame 20 may be formed by processing a single member.

According to another modified example of the third embodiment, a second air outlet 430 is formed on the bottom panel 212 defining the bottom of the top frame 210. The second air outlet 430 may be formed in a rectangular shape or with slits formed on the bottom panel at a predetermined interval. Instead of forming the second air outlet, a special passage may be formed to direct the hot air into the top frame.

In the above-description, the third air outlet 450 is formed on each of the side panels 214. However, the present invention is not limited to this configuration. For example, the third air outlet 450 functioning to discharge the hot air out of the top frame 210 may be further formed on the rear panel 213 and/or the top panel 211 as well as the side panels 214. In this case, since the air outlet area increases, the hot air can be more effectively discharged. However, when the air outlet area increases, the area through which the water can be introduced also increases. The air outlet formed on the rear panel 213 and the top panel 211 is not formed on an entire area but at intervals. In this case, a process for making the top frame 210 is complicated. However, the hot air discharging efficiency is improved. That is, a relatively large amount of the hot air can be discharged within a limited time.

Alternatively, the side panels 214 may be formed further extending frontward and the third air outlet 450 is provided on an extending portion of each of the side panels 214 to increase an area of the third outlet 450. In this case, since the top plate and the cabinet are sealed together at the side surfaces, the water cannot flow into the main body. Therefore, no water is introduced into the main body through the side panels 214 while increasing an area through which the air is discharged. As a result, since the hot air can be effectively discharged and thus the safety in using the cooker can be enhanced. In this case, the third air outlet 450 can be provided at a location higher than the top surface of the cabinet 100. Therefore, the reliability for preventing the water from flowing into the main body 300 through the air outlet formed on the top frame 210 can be enhanced.

In the above-description, the top frame 210 is disposed along the top edge of the top plate 200. However, the present invention is not limited to this embodiment. For example, the top frame 210 may be installed on the front and both side edge portions of the top plate 200.

In addition, the top frame 210 located on the rear edge portion of the top plate 200 is formed such that a surface bent downward from the front end portion of the bottom panel 212 is coupled to the rear surface of the main body 300.

In the above-described embodiments, the air outlet formed on the top frame 210 keeps its opened state. However, the present invention is not limited to this configuration. For example, an air outlet cover for selectively opening and closing the air outlet may be provided. In this case, the outer appearance of the product may be deteriorated.

Fourth Embodiment

A fourth embodiment is substantially identical to the first to third embodiments except for a support structure and a supporting coupling method. Only the different parts will be described herein.

Figure 19:
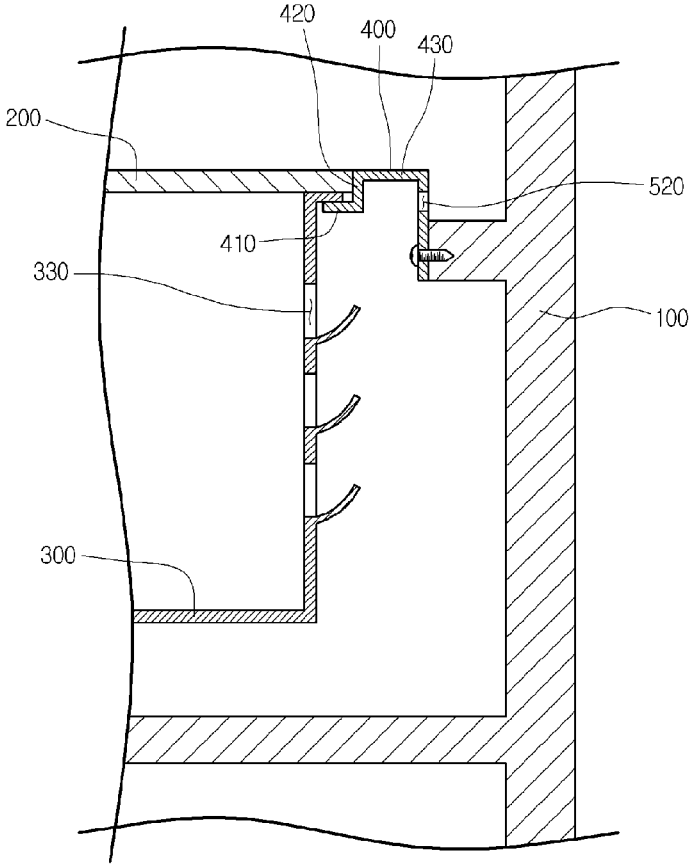
FIGS. 19 and 20 are sectional views of major portions of a fourth embodiment.
Figure 20:
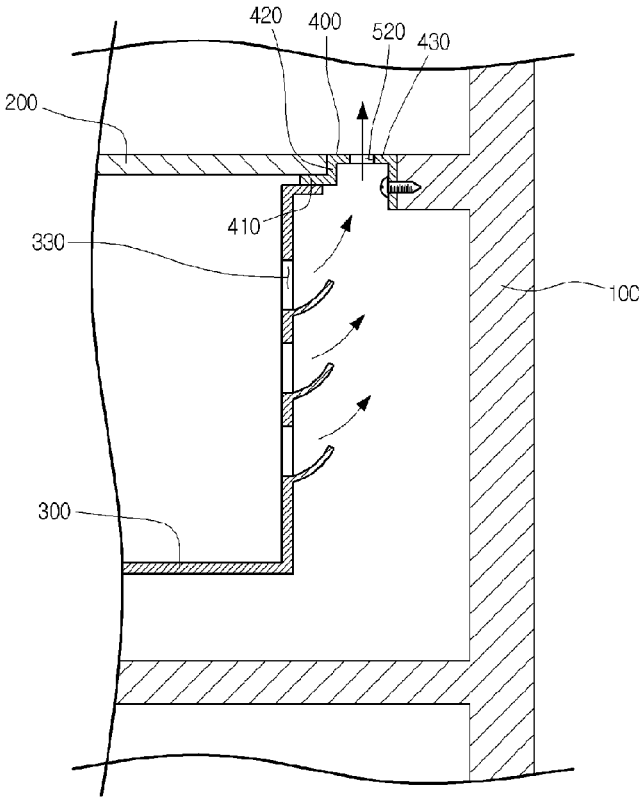

FIGS. 19 and 20 are sectional views of major portions of a fourth embodiment.

Referring to FIGS. 19 and 20, a rear end portion of the top plate 200 is spaced apart from a cabinet 100. A support 400 is located in the space between the rear end portion of the top plate 200 and the cabinet 100.

The support 400 supports a rear end portion of an under surface of the top plate 200 and a rear surface of the top plate 200. The under and rear surfaces of the top plate 200 may be fixed on the support 400 by adhesive or by self-elastic force. The cabinet 100 and the support 400 are coupled to each other by a screw. The main body 300 is formed of a frame, an upper end of which is bent extending in an extending direction of the top plate 200 or in an opposite direction of the extending direction of the top plate 200. The bent portion fixedly contacts the support 400.

The support 400 has a bottom supporting portion 410 supporting an rear end portion of an under surface of the top plate 200, a rear surface supporting portion 420 supporting a rear surface of the top plate 200, and a coupling portion 430 that is bent rearward from an upper end portion of the rear surface supporting portion 420, extends by a predetermined length, and further bent downward.

The bottom supporting portion 410 is formed of a rectangular plate having a predetermined thickness and extending in a horizontal direction. The bottom supporting portion 410 is located at the rear end portion of the under surface of the top plate 200. A flange portion bent rearward along an upper end portion of a rear surface of the main body is located between the top surface of the bottom supporting portion 410 and the under surface of the top plate 200. Therefore, the bottom supporting portion 410 supports the rear end of the under surface of the top plate 200 (see FIG. 19).

In addition, the flange of the main body 300 may be located between the rear end portion of the under surface of the top plate 200 and the bottom supporting portion 410. The top surface of the bottom supporting portion 410 contacts the rear end portion of the under surface of the top plate 200 and the flange of the main body 300 may be located under the rear end portion of the under surface of the top plate 200 (see FIG. 20).

When the top surface of the bottom supporting portion 410 is located under the rear end portion of the under surface of the top plate 200, the downward separation of the rear portion of the top plate can be prevented.

The rear surface supporting portion 420 is formed in an erected rectangular shape having a predetermined thickness and extending in a horizontal direction. The rear surface of the top plate contacts the front surface of the rear surface supporting portion 420 to prevent the top plate 200 from being separated rearward. At this point, the rear surface of the top plate 200 contacts the front surface of the rear surface supporting portion 420. The rear supporting portion 420 may supports the top plate 200 without contacting the rear surface of the top plate 200. However, in order to stably support the top plate 200, the rear surface supporting portion 420 preferably contacts the top plate 200.

The coupling portion 430 that is bent rearward from an upper end portion of the rear surface supporting portion 420, extends by a predetermined length, and further bent downward has a rear surface that is fixedly coupled to the cabinet 100. By the structure of the coupling portion 430, a predetermined distance between the rear surface of the top plate 200 and the cabinet 100 is uniformly maintained.

The rear surface of the coupling portion 430 and the front surface of the cabinet 100 are fixedly coupled or adhered to each other by a coupling member such as a screw, a hook member, or an adhesive. In this embodiment, the screw is used as the coupling member by way of example.

When the rear surface of the coupling portion 430 is coupled to the cabinet by the screw, the top plate 200 is supported by the support 400. Therefore, the downward and rearward separation of the top plate 200 can be prevented.

When the bottom supporting portion 410 and the rear surface supporting portion 420 are formed in a ⌟-shape when viewed from a side to support the under and rear surfaces of the rear end portion of the top plate 200. The coupling portion 430 is formed in a ¬-shape to uniformly maintain the distance between the rear surface of the top plate 200 and the cabinet 100. The rear surface of the coupling portion 430 is fixedly coupled to the cabinet 100.

The coupling portion 430 is provided with a second opening 520 through which the hot air under the support 400 is discharged out of the cabinet 100. The second opening 520 is provided in the form of a hole having any shape.

The second opening 520 may be formed any one of horizontal and vertical sections of the coupling portion 430. When the second opening 520 is formed on the horizontal section, the hot air under the support 400 flows upward and is discharged out of the cabinet 100. When the second opening 520 is formed on the vertical section, the hot air flows toward the rear portion of the cooker and is discharged out of the cabinet 100.

The support 400 is formed with a predetermined size. A plurality of the supports 400 may be mounted between the rear end portion of the top plate 200 and the cabinet 100 at predetermined intervals to support the top plate 200. Alternatively, one large sized support is provided to support the top plate.

The main body 300 is provided at the rear surface with a first opening 330 through which the hot air is discharged out of the main body 300. The air discharged out of the main body 330 is directed to the second opening 520. The second opening 520 is preferably formed on the vertical section of the coupling portion 430 to discharge the air in a direction away from the top plate 200, thereby protecting the user from the hot air that is being discharged. In this case, the second opening 520 is not exposed to the external side.

Figure 21:
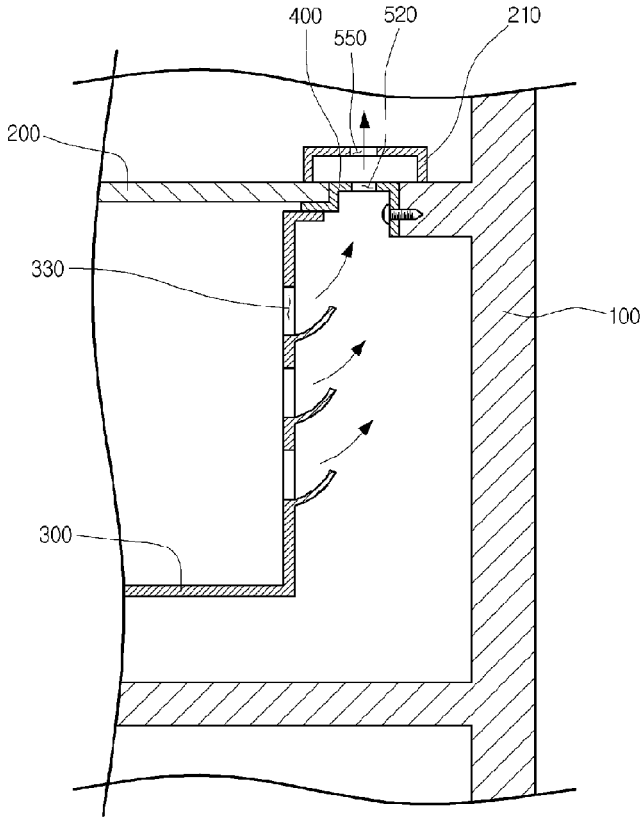
FIG. 21 is a view of a modified example of the third embodiment.

FIG. 21 shows a modified example of this embodiment. A top frame 210 for covering a space between the rear end of the top plate 200 and the top surface of the cabinet 100 is further provided. When the top frame 210 is located above the support 400, the top frame 210 is provided with a third air outlet 550 through which the hot air can be discharged out of the main body 300.

Meanwhile, in FIG. 21, the third air outlet 550 is formed in an identical direction to the air outlet of the support 400. However, the present invention is not limited to this configuration. The third air outlet may be provided rearward.

A variety of other modified examples can be provided. For example, the second air outlet 520 of FIG. 19 is formed sideward and the third air outlet 550 is formed upward. As the second and third air outlets are formed in different directions, the water inflowing from the external side can be further prevented.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

According to the built-in cooking appliance of the present invention, the cooling efficiency for the hot plate and the safety can be enhanced. Furthermore, the cleaning convenience and reliability of the product can be improved.

The invention claimed is:

1. A built-in cooking appliance comprising:

a main body having an air hole;

a top plate provided above the main body, wherein the top plate is directly supported by a cabinet and the main body;

a support forming an airflow space between a side of the top plate and the cabinet and that directly supports two or more surfaces of the top plate and seated on the cabinet; and an air outlet allowing internal air of the main body to be discharged through the support, the air outlet formed on the support, wherein air discharged from the air hole of the main body flows to the air outlet, after flowing through a space defined between the main body and the cabinet and air discharged from the air hole of the main body is capable of contacting the cabinet in the space, wherein the support supports a lower surface of the two or more surfaces of the top plate.

2. The built-in cooking appliance according to claim 1, wherein the support comprises:

a supporting portion supporting the two or more surfaces of the top plate; and a contacting portion contacting the cabinet.

3. The built-in cooking appliance according to claim 2, wherein the supporting portion contacts under, rear, and top surfaces of the top plate, so that the supporting portion wraps the top plate.

4. The built-in cooking appliance according to claim 2, wherein a connecting portion connecting the supporting portion and the contacting portion defines a top frame covering the airflow space.

5. The built-in cooking appliance according to claim 2, wherein the contacting portion contacts a side surface or a top surface of the cabinet.

6. The built-in cooking appliance according to claim 2, wherein a lower surface of the top plate is located at a same horizontal level as a top surface of the cabinet.

7. The built-in cooking appliance according to claim 2, wherein the supporting portion supports an upper surface of the two or more surfaces of the top plate and the contacting portion contacts a side surface of the cabinet.

8. The built-in cooking appliance according to claim 2, wherein the supporting portion supports a side surface of the two or more surfaces of the top plate and the contacting portion contacts a side surface of the cabinet.

9. The built-in cooking appliance according to claim 1, wherein the air outlet is longitudinally provided on the support.

10. The built-in cooking appliance according to claim 1, wherein the support is a top frame and the top frame is provided with at least a side air outlet formed at an edge extending in a length direction.

11. The built-in cooking appliance according to claim 1, wherein the air outlet discharges the air in a corner extending direction of the top plate.

12. A built-in cooking appliance comprising:

a main body in which a heat source is disposed and having an air hole;

a top plate provided above the main body, wherein the top plate is directly supported by a cabinet and the main body; and a support to support the top plate and having an air outlet allowing internal air of the main body to be discharged through the support, wherein the support comprises a supporting portion directly supporting a plurality of surfaces of the top plate and a contacting portion contacting the cabinet, wherein the support supports the top plate such that the top plate is spaced apart from the cabinet to form an opening through which air passes, and wherein air discharged from the air hole of the main body flows to the opening, after flowing through a space defined between the main body and the cabinet and air discharged from the air hole of the main body is capable of contacting the cabinet in the space, wherein the support supports a lower surface of the plurality of surfaces of the top plate.

13. The built-in cooking appliance according to claim 12, wherein the support supports rear and top surfaces of the plurality of the surfaces of the top plate.

14. The built-in cooking appliance according to claim 12, wherein the support further comprises a connecting portion connecting the supporting portion to the contacting portion and the connecting portion is bent several times to cover a space between the cabinet and the top plate.

15. A built-in cooking appliance comprising:

a top plate, at least a portion of the top plate being directly supported by a cabinet;

a main body disposed under the top plate, wherein the main body is received in the cabinet and directly supports a lower surface of the top plate;

a support that is disposed under the top plate to support the top plate and has a first portion directly supporting an under surface of the top plate and a second portion coupled to the cabinet;

a first opening that is formed on the main body to allow internal fluid of the main body to be discharged out of the main body; and a second opening that is formed on the support such that the fluid discharged through the first opening passes through the second opening, wherein air discharged from the first opening of the main body flows to the second opening, after flowing through a space defined between the main body and the cabinet and air discharged from the first opening is capable of contacting the cabinet in the space.

16. The built-in cooking appliance according to claim 15, wherein the support is designed such that a height thereof is adjustable.

17. A built-in cooking appliance comprising:

a top plate, at least a portion of the top plate being supported by a cabinet;

a main body disposed under the top plate, wherein the main body is received in the cabinet;

a top frame disposed above a first space defined between at least a corner of the top plate and the cabinet so as to cover the space, wherein the top frame comprises a lower panel in contact with a lower surface of the top plate, an upper panel in contact with a top surface of the top plate, and a pair of side panels in contact with both side surfaces of the top plate;

a first fluid outlet that is formed on the main body to allow internal fluid of the main body to be discharged out of the main body;

a second fluid outlet that is formed on the lower panel of the top frame to allow the fluid passing through the first opening into the top frame; and a third fluid outlet that is formed on at least one of the pair of side panels to allow the fluid discharged through the second opening to an external side of the top frame, wherein air discharged from the first fluid outlet of the main body flows to the second fluid outlet, after flowing through a second space defined between the main body and the cabinet and air from the first fluid outlet is capable of contacting the cabinet in the second space.

18. The built-in cooking appliance according to claim 17, wherein the fluid is discharged through the third fluid opening in a direction intersecting a direction in which the fluid passing through the second fluid outlet flows.

19. The built-in cooking appliance according to claim 17, wherein the fluid directed to the second fluid outlet is discharged in a length direction of the top frame.

20. A built-in cooking appliance comprising:

a top plate, at least a portion of the top plate being directly supported by a cabinet;

a main body disposed under the top plate and receiving a heat source, wherein the main body is received in the cabinet and directly supports a lower surface of the top plate;

a support disposed between the top plate and the cabinet and having a first portion supporting directly the top plate at a rear portion of the top plate, a second portion directly supporting an under surface of the top plate, and a third portion coupled to the cabinet;

a first opening that is formed on the main body to allow internal fluid of the main body to be discharged out of the main body; and a second opening that is formed on the support to allow the fluid discharged through the first opening to an external side, wherein air discharged from the first opening of the main body flows to the second opening, after flowing through a space defined between the main body and the cabinet and air from the first opening is capable of contacting the cabinet in the space.

21. The built-in cooking appliance according to claim 20, wherein a predetermined distance between the top plate and the cabinet is maintained by the support.

* * * * *